US006840203B2

(12) United States Patent
Wakitani et al.

(10) Patent No.: US 6,840,203 B2
(45) Date of Patent: Jan. 11, 2005

(54) ENGINE STARTING DEVICE

(75) Inventors: Tsutomu Wakitani, Saitama (JP); Toshinori Inagawa, Saitama (JP)

(73) Assignee: Honda Giken Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/462,677

(22) Filed: Jun. 17, 2003

(65) Prior Publication Data

US 2004/0000281 A1 Jan. 1, 2004

(30) Foreign Application Priority Data

Jun. 27, 2002 (JP) ..... P2002-187812

(51) Int. Cl.[7] ..... F02N 17/00

(52) U.S. Cl. ..... 123/179.3; 123/179.4; 123/179.25; 123/179.28; 290/38 E; 290/36 R; 290/37 R; 290/38 R; 701/112; 701/113

(58) Field of Search ..... 123/179.3, 179.4, 123/179.25, 179.28; 290/36 R, 37 R, 38 E, 38 R; 701/112, 113

(56) References Cited

U.S. PATENT DOCUMENTS 5,458,098 A 10/1995 Yagi et al. ..... 123/179.3
6,275,759 B1 * 8/2001 Nakajima et al. ..... 701/54
6,434,475 B2 * 8/2002 Kaneko et al. ..... 701/112
6,466,860 B2 * 10/2002 Kaneko ..... 701/112

FOREIGN PATENT DOCUMENTS

| | | |
|---|---|---|
| JP | 03-003969 | 1/1991 |
| JP | 7-71350 | 3/1995 |
| JP | 08-308286 | 11/1996 |

* cited by examiner

*Primary Examiner*—Willis R. Wolfe
*Assistant Examiner*—Johnny H. Hoang
(74) *Attorney, Agent, or Firm*—Westerman, Hattori, Daniels & Adrian, LLP

(57) ABSTRACT

Engine starting performance is enhanced by a brushless motor having no rotor position detecting sensor. In the first place an engine is rotated forward and then is reversely rotated to overcome a high load region of the engine. Then, the engine is accelerated and rotated forward and started. In a light load region of the engine, the engine is immediately accelerated and normally rotated. It is judged whether the region of the engine is the high load region or light load region based on the rotation speed when the starting operation is started. After the starting operation is started, if the forward rotation speed reaches a first speed, and a second speed which is higher than the first speed is obtained even after predetermined time is elapsed, an immediate starting-judging section 36 outputs a detection signal to a starting/normal rotation control section 37.

4 Claims, 7 Drawing Sheets

ENGINE STARTING DEVICE

BACKGROUND OF THE INVENTION

1. Field of the Invention

The present invention relates to an engine starting device, and more particularly, to an engine starting device which is suitable for overcoming a load of compression stroke of the engine and securely starts the engine.

2. Description of the Related Art

A large torque is required to move a piston beyond a top dead center at a compression stroke of an engine. Therefore, if the engine is started from a position where the piston is stayed at crank angle about 90° before the top dead center, the piston can not often move beyond the top dead center because of high load. An output torque which is high enough to overcome the high load region of the compression stroke is required for a starter that is a motor used for the engine starting device.

If the need could be avoided for starting the engine from such a high load region or from a region immediately before the high load region, it would be possible to overcome the compression stroke even with a starter motor having relatively small torque. Japanese Patent Application Laid-Open No. H7-71350 discloses a starting device in which a crank angle is confirmed at the time of starting of the engine, preliminary rotation including reverse rotation of a predetermined rotation angle or predetermined time corresponding to the crank angle is required and then, normal forward rotation is required. This reference publication also discloses a starting device in which a load torque reducing direction is judged from the crank angle, preliminary rotation is required in the torque reducing direction and then, normal forward rotation is required.

This starting device is realized based on the phenomenon that a friction surface is brought into a substantially dynamical friction surface due to spread of oil caused by reverse rotation, that is preliminary rotation, the friction coefficient is lowered and the load torque is reduced. Enhancement of starting performance is expected as compared with a case in which the engine is normally rotated immediately after the starting command.

In the above conventional starting device, the enhancement of starting performance can be expected to some extent even if a starter motor having not so great starting torque is used. However, this starting device is not sufficient for overcoming the high load region of the compression stroke.

Further, in order to confirm the crank angle as a starting position and to preliminarily rotate reversely only through a rotation angle or for a time period corresponding to the crank angle, detecting means of the starting position is essentially required, and this is not preferable for utilization for general starting devices. Especially when a brushless motor having no position detecting sensor of a rotor is used as a starter motor, it is necessary to provide engine position detecting means as described in Japanese Patent Application Laid-Open No. H7-71350.

In Japanese Patent Application Laid-Open No. H7-71350, if the forward rotation direction is the load torque reducing direction when the crank angle is confirmed, the motor is allowed to rotate forwardly as it is. It is judged whether the starting is successful or failed depending upon whether the engine revolution number exceeds a threshold value revolution number after a predetermined time is elapsed. However, since long time is required for judging whether it is possible to overcome the high load region at the time of forward rotation, there is a problem that too much time is required for restarting when the starting has failed.

SUMMARY OF THE INVENTION

The present invention provides an engine starting device capable of moving a piston to a forward rotation starting position where a large inertial force can be obtained without confirming or detecting a starting position, and capable of starting the engine with an engine starting torque utilizing the large inertial force from that position.

A first feature of this invention comprising a drive-control means for driving the motor in accordance with a starting-target revolution number when the following two conditions in which initial excitation current is allowed to flow through the motor to forward rotate the engine are satisfied, a first condition in which the rotation speed reaches a first speed within first period of time from when the motor is started to rotate, and a second condition in which a second speed higher than the first speed is obtained after second period of time longer than the first period of time is elapsed.

According to the first feature, if the rotation speed of the motor reaches the first speed, the first condition representing the start of the motor is satisfied. Then, if the engine rotates at least at the second speed, the second condition that the engine or piston stroke is not at the high load position, that is, the piston could move beyond the high load region is satisfied. When the second condition is satisfied, since it is possible to immediately accelerate to start the engine, the engine is accelerated and rotated at a dash in accordance with a target revolution number for the time of start.

Even if the rotation speed is restrained by low initial exciting current, since the second speed is obtained, it is possible to reliably judge that the piston or engine has moved beyond the high load region.

A second feature of this invention is constructed the drive-control means flows the initial excitation current through the motor so as to rotate the engine reversely when at least one of the two conditions is not satisfied, and after the rotation speed is once increased and then the rotation speed is reduced to a value equal to or lower than a third speed, the drive-control means drives the motor forward in accordance with the starting-target revolution number.

According to the second feature, if the second condition is not satisfied, it is judged that the piston is in the high load region and the engine is rotated reversely. Since the load is reduced when the engine is reversely rotated from the high load position, it is possible to rotate the motor reversely to a position where the engine load is further increased. That is, the motor is reversely rotated until the position where the load at the time of forward rotation is further decreased. By forward rotation of the engine after the motor is moved to the position where the engine can be started with low load in this manner, it is possible to move the piston beyond the high load region of the compression stroke at a dash by means of a motor having small torque and to accelerate the engine up to the cranking rotation speed.

A third feature of this invention is that the motor is a brushless motor, the engine starting device has three phase stationary windings, and when driving electricity is allowed to flow through two phases, a rotation position signal and a rotation speed signal of a rotor are formed based on a voltage signal which is induced to a winding which is not excited, and the rotation speed detecting means detects the rotation speed of the motor based on the rotation speed signal.

A fourth feature of this invention is that the motor is a brushless motor, a rotation position signal and a rotation speed signal of a rotor are formed based on a difference between a current output value which passes through a stationary winding and a current measurement value of the stationary winding, and the rotation speed detecting means detects the rotation speed of the motor based on the rotation speed signal.

According to the third and fourth features, since the rotation speed of the motor, that is the rotation speed of the engine at start is detected based on the induction voltage of the winding or current supplied to the wining, it is possible to determine the inversion position of the forward rotation and the reverse rotation of the motor based on the rotation speed even if a rotation position sensor of the motor or engine is not provided.

DETAILED DESCRIPTION OF THE PREFERRED EMBODIMENTS

Figure 2:
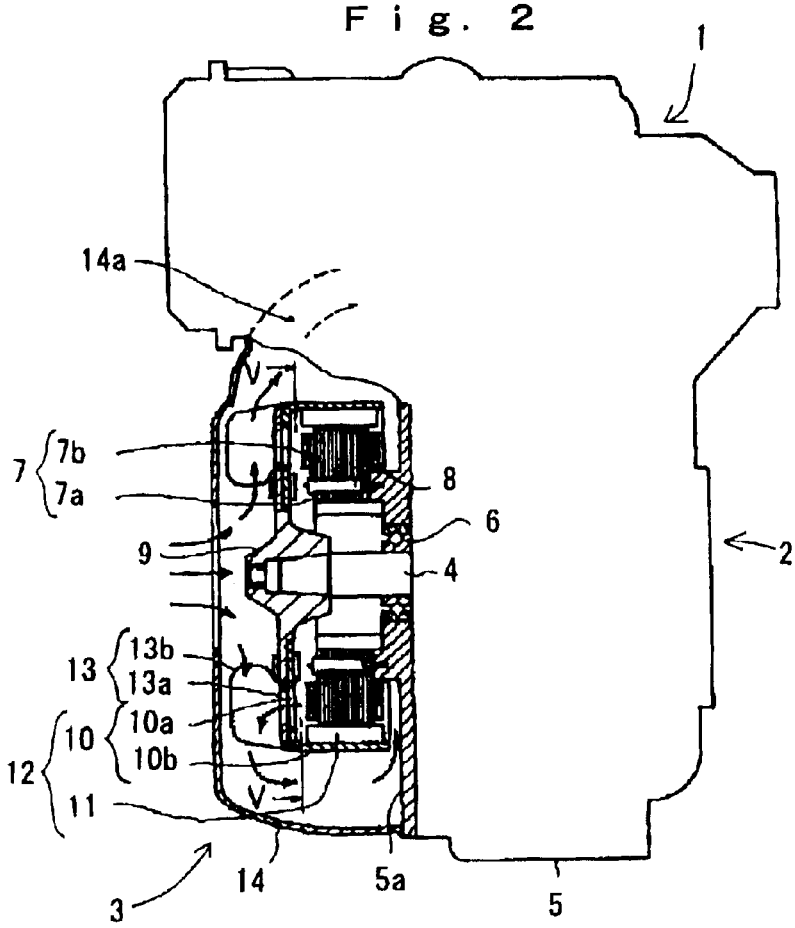
FIG. 2 is a side view of an engine generator using a brushless motor as a starter motor.
Figure 3:
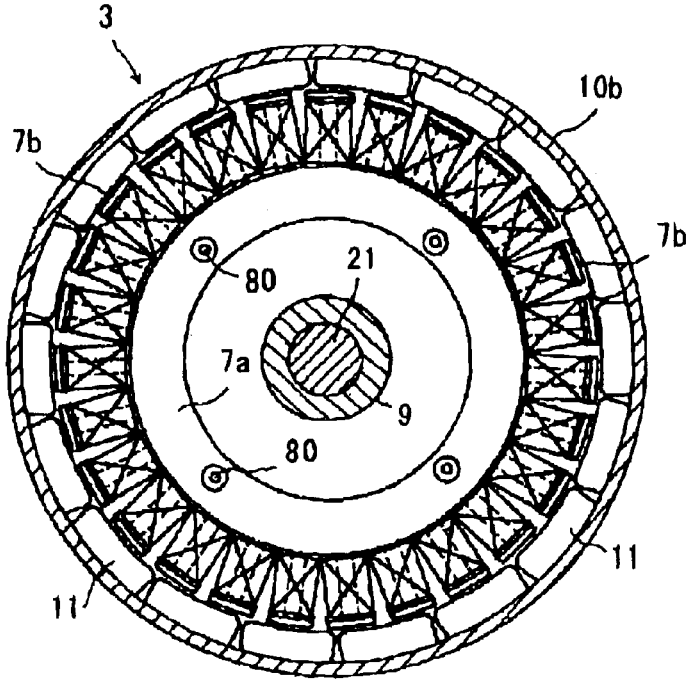
FIG. 3 is a sectional view taken along a line V—V in FIG. 2.

An embodiment of the present invention will be explained in detail with reference to the drawings. FIG. 2 is a side view of an engine generator using a brushless motor as a starter motor. FIG. 3 is a sectional view taken along a line V—V in FIG. 2. An engine generator 1 has a four-cycle internal combustion engine 2 and a magnetic type multipolar generator 3. The generator 3 is a generator motor, and also functions as a motor. Details thereof will be described later. A crankshaft 4 of the engine 2 is supported by a bearing 6 or the like provided on a sidewall 5*a* of a crank case 5 and in this state, the crankshaft 4 extends out of the engine 2. An annular iron core 7 is fixed to a peripheral portion of a boss provided on the sidewall 5*a* of the crank case 5 which surrounds the crankshaft 4 by means of bolts 80. The iron core 7 comprises an annular yoke 7*a*, and 27 salient poles 7*b* which radially project from the yoke 7*a*. Three phase windings are sequentially wound around the salient pole 7*b* alternately to constitute a stator 8.

A forged hub 9 is mounted to a tip end of the crankshaft 4. A flywheel 10 which also functions as a rotor yoke is connected to the hub 9. The flywheel 10 comprises a disk portion 10*a* which is formed by press forming high tensile steel plate into a cup-shape, and a cylindrical portion 10*b*. The disk portion 10*a* is fixed to the hub 9, and the cylindrical portion 10*b* is mounted such as to cover an outer side of the salient poles 7*b* of the iron core 7.

On an inner peripheral surface of the cylindrical portion 10*b* of the flywheel 10, 18 neodymium magnets 11 having strong magnetic force are fixed along the circumferential direction, thereby constituting an outer rotor type magnetic rotor 12. In the rotor 12, the magnets 11 are spread over the inner peripheral surface of the cylindrical portion 10*b* to secure sufficient mass, and the rotor 12 can exhibit function as a flywheel.

A cooling fan 13 is mounted to the disk portion 10*a* of the flywheel 10. The cooling fan 13 has an annular board 13*a*, and a plurality of blades 13*b* rise from one side surface of the board 13*a* along the circumferential direction. The board 13*a* is fixed to an outer surface of the disk portion 10*a* of the flywheel 10. A fan cover 14 covering the cooling fan 13 forms a wind passage 14*a* extending from a side of the flywheel 10 to the engine 2, through which cool air passes.

Figure 4:
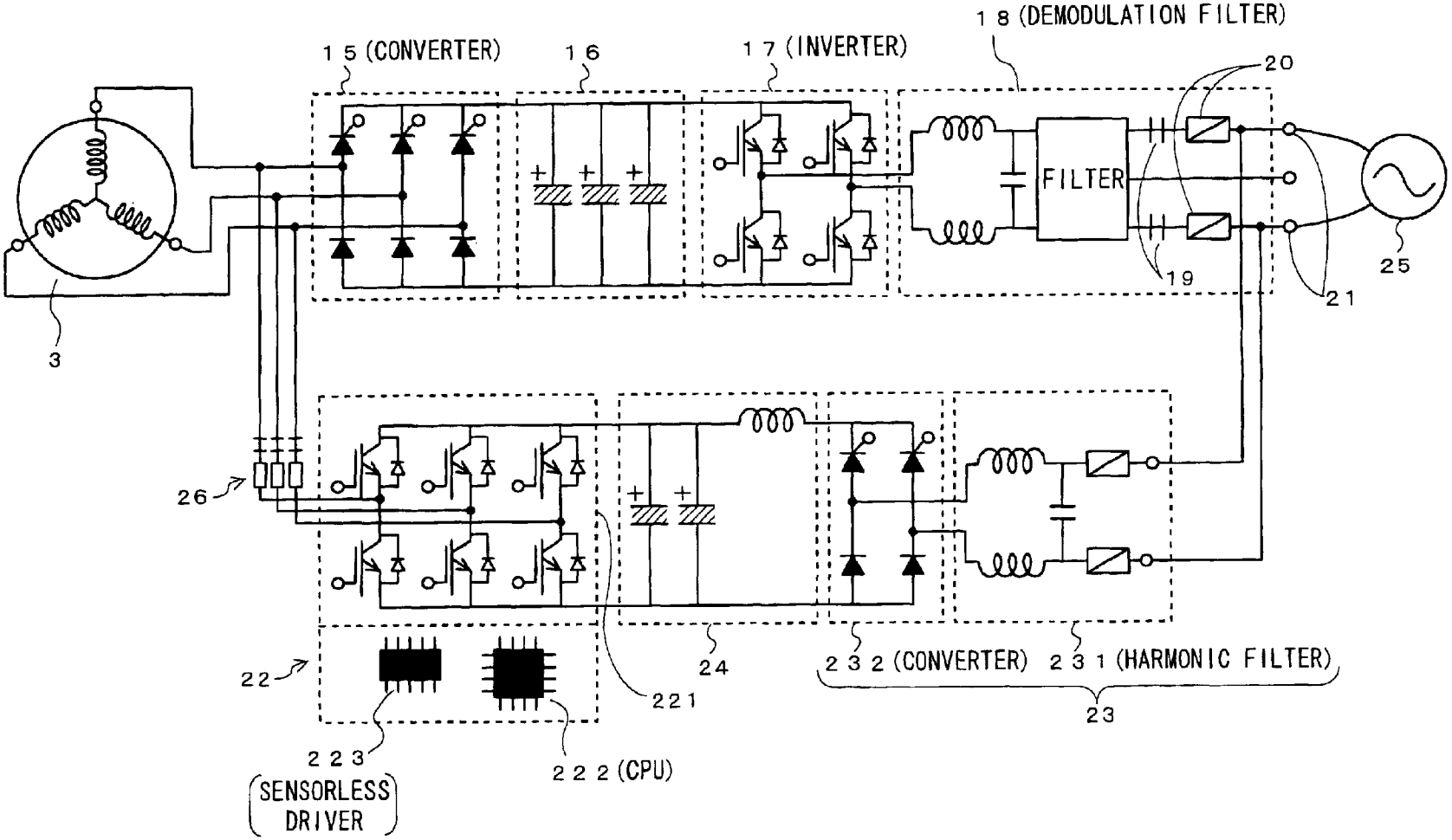
FIG. 4 is a system structure diagram of the engine generator.

FIG. 4 shows a system structure diagram of the engine generator 1. The generator 3 is driven by the engine 2 to generate three-phase AC. The output AC of the generator 3 is full-wave rectified by a converter 15 comprising a rectifier circuit in which a semiconductor rectifying device is assembled into a bridge, and is converted into DC. The DC which is output from the converter 15 is smoothened by a capacitor smoothing circuit 16, and is input to an inverter 17, and is converted into AC having predetermined frequency by an FET bridge circuit which constitutes the inverter 17. The AC which is output from the inverter 17 is input to a demodulation filter 18, and only low frequency component (e.g., commercial frequency) passes through the demodulation filter 18. The AC which has passed through the demodulation filter 18 is connected to an output terminal 21 through a relay 19 and a fuse 20. The relay 19 opens when the engine 2 is started, and closes after the engine 2 rotates in a predetermined state.

The generator 3 of the engine generator 1 is the generator-motor as described above, and the generator 3 can be used as a starter motor for starting the engine 2. When the generator 3 is used as the starter motor, the generator 3 is referred to as a starter motor 3*a*, hereinafter. A starter driver 22 for starter motor 3*a* is provided. In order to supply current for starting the engine 2 to the starter driver 22, a rectifier circuit 23 and a smoothing circuit 24 are provided. The rectifier circuit 23 is provided with a harmonic filter 231 and a converter 232. The harmonic filter 231 is connected to the output terminal 21.

An output side of the generator 3 is connected to a single-phase power supply 25 of AC200V for example, and AC is supplied from the power supply 25 when the engine is started. This AC is input to the harmonic filter 231 and harmonic is eliminated and is converted into DC by the converter 232 and then, the DC is supplied to the starter driver 22 as control power source through the smoothing circuit 24.

An output side of the starter driver 22 is connected to each phase of the three-phase windings of the generator 3 through a relay 26. The relay 26 closes when the engine 2 is started, and opens after the engine 2 rotates in a predetermined state. In order to start the engine 2, current is sequentially supplied to each phase of the three-phase windings of the generator 3 in a predetermined order. There are provided an inverter 221 comprising a switching element (FET) for sequentially supplying current to the windings of each phase, a CPU 222, and a sensorless driving section 223 (comprising IC) which does not use a sensor for detecting a position of the rotor 12.

Figure 5:
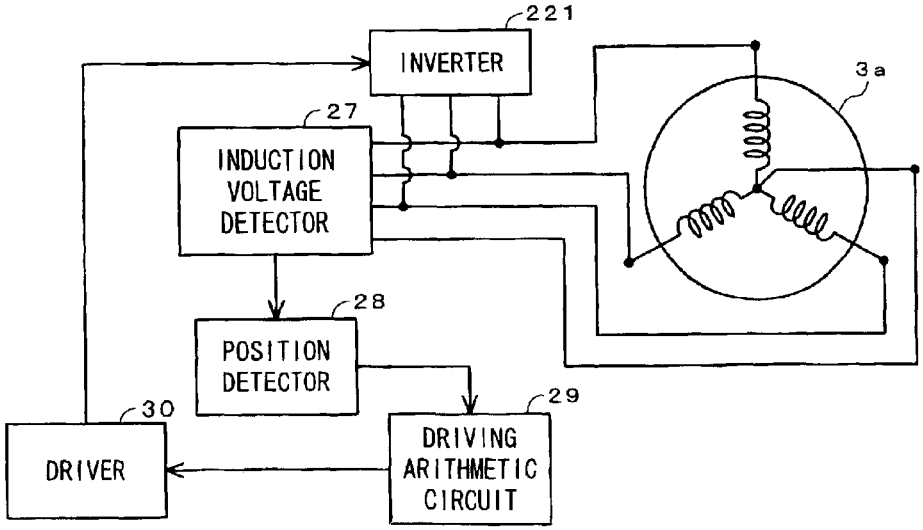
FIG. 5 is a block diagram showing functions of essential portions of a sensorless driving section.

FIG. 5 is a block diagram showing function of an essential portion of the sensorless driving section 223. When electricity is supplied between two phases of the stator 8 from the inverter circuit 221 and the rotor is rotated, an induction voltage detector 27 detects a waveform of a voltage signal which is induced between an intermediate point and the remaining one phase. A position detector 28 judges a positional relation, that is, rotation position between the magnets of the rotor 12 and the phases of the stator 8 based on the detected voltage waveform. A driving arithmetic circuit 29 calculates a cycle for driving the respective switching elements of the inverter circuit 221 based on the positional relation between the phases of the stator 8 and the magnets of the rotor 12. A driving section 30 supplies excitation signal to the inverter circuit 221 based on the cycle calculated by the driving arithmetic circuit 29.

Figure 6:
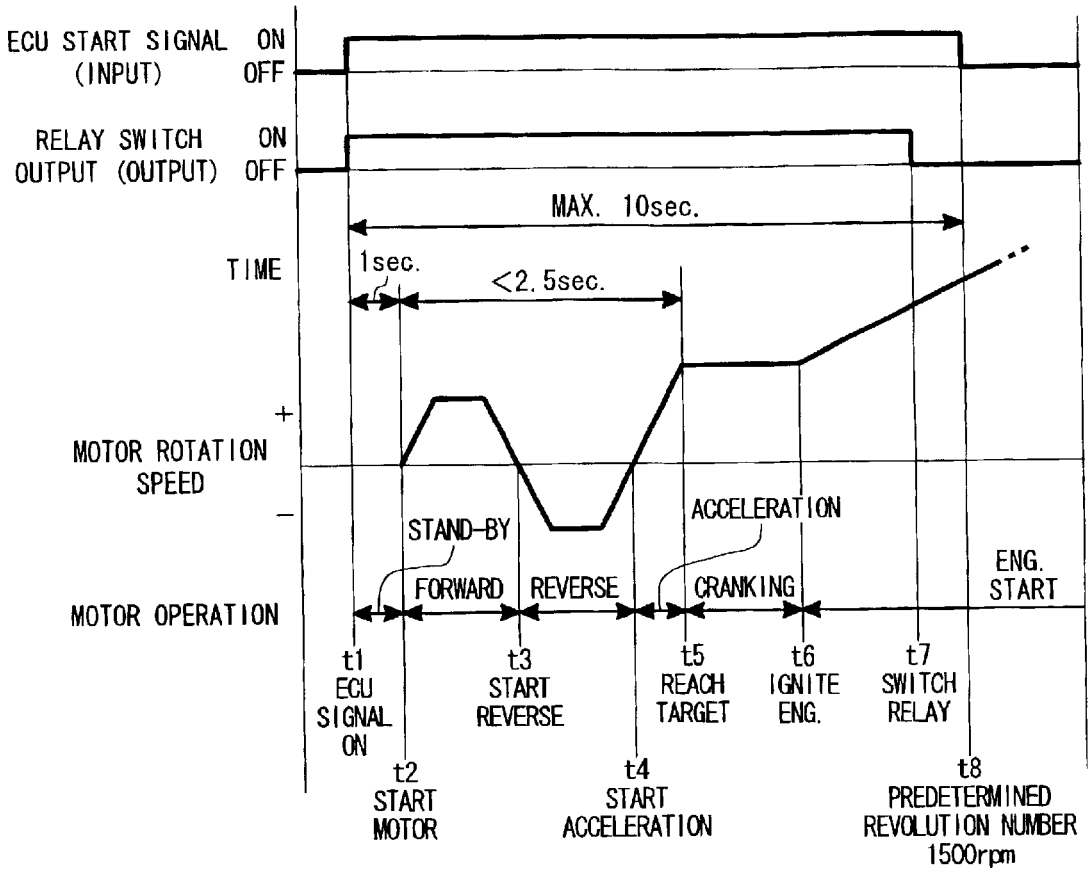
FIG. 6 is a time chart showing the entire operation of start control of the engine generator.

FIG. 6 is a time chart showing the entire operation of the start control of the engine generator 1. At timing t1, a start signal of an electrical control unit (ECU) is turned ON in response to an engine start command. After stand-by time (e.g., one second), the relays 19 and 26 are switched to a control mode for the starter motor 3*a* at timing t2 for forward rotation of the starter motor 3*a*. If the rotation speed becomes equal to or lower than a predetermined value during the forward rotation, it is judged that the engine reaches a high load region, and the starter motor 3*a* is reversely rotated at timing t3. During the forward rotation and reverse rotation, the starter motor 3*a* is driven with initial excitation current which is smaller than current which is always supplied during ordinary operation. By suppressing the rotation speed by such a small initial excitation current, it is possible to easily stop the starter motor 3*a* at a position where it is expected that sufficient starting torque can be obtained at the high load position, that is a position where the motor 3*a* can be easily turn over its rotation direction during the forward rotation and reverse rotation, and it is possible to suppress the reaction force (reaction force is large if the rotation speed is large) when the engine can not get over the high load position.

The starter motor 3*a* is rotated forward and reversely and when the crankshaft 4 is positioned at a position where it is expected that sufficient starting torque can be obtained, that is at timing t4, the acceleration of the starter motor 3*a* is started in the forward rotation direction. During the forward rotation, current which is higher than the initial excitation current is supplied to the starter motor 3*a*.

If the starter motor 3*a* reaches a cranking target rotation speed at timing t5, the rotation speed is maintained during cranking. The engine is ignited at timing t6 and after the initial explosion, the engine revolution number starts increasing, the relay 19 is closed at timing t7, the relay 26 is opened and the control mode is switched to a control mode of the generator 3. A start signal of the ECU is maintained until timing t8 (e.g., 10 seconds from timing t1), but if the engine revolution number does not reach a predetermined revolution number (e.g., 1,500 rpm) until timing t8, it is judged that the starting operation failed after the initial explosion, and the start signal is again turned ON after a predetermined time (e.g., 10 seconds).

A position where the forward rotation and reverse rotation for operating the starter motor 3*a* at a position where it is expected that sufficient starting torque can be obtained is stopped, is judged when the rotation speed of the starter motor 3*a* becomes equal to or lower than a set value. The rotation speed of the starter motor 3*a* can be calculated based on the cycle of the induction voltage waveform for example.

Figure 8:
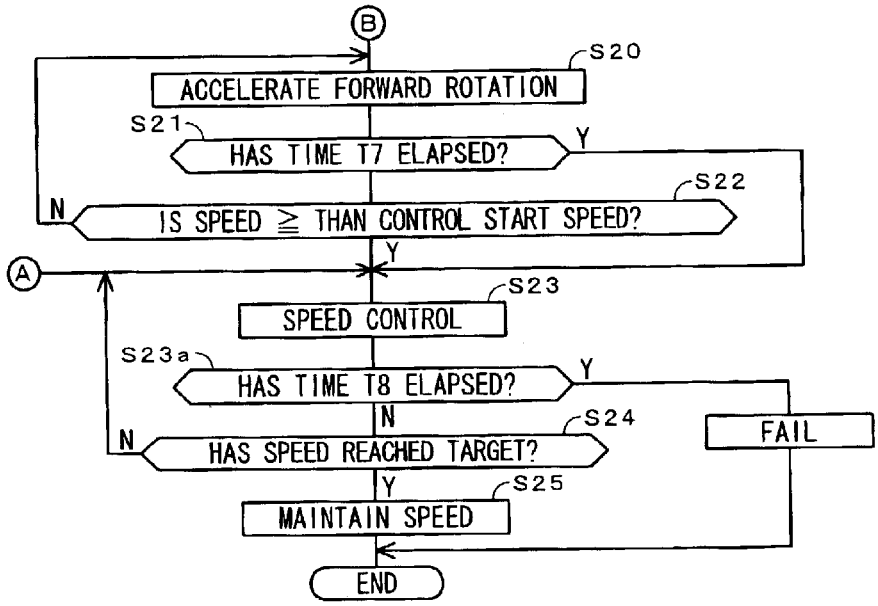
FIG. 8 is a flowchart (part 2) of the start control of the engine generator.
Figure 7:
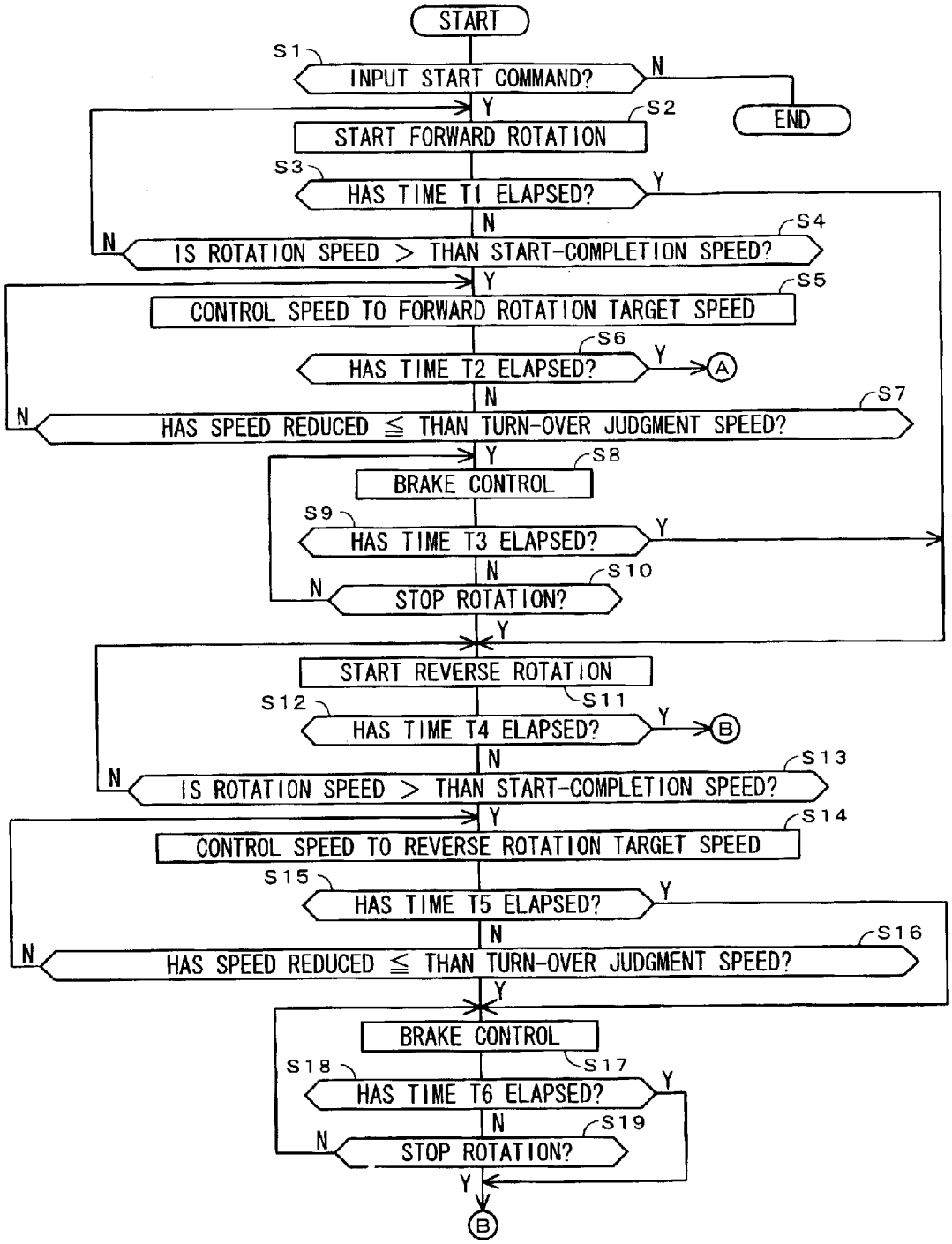
FIG. 7 is a flowchart (part 1) of the start control of the engine generator.
Figure 9:
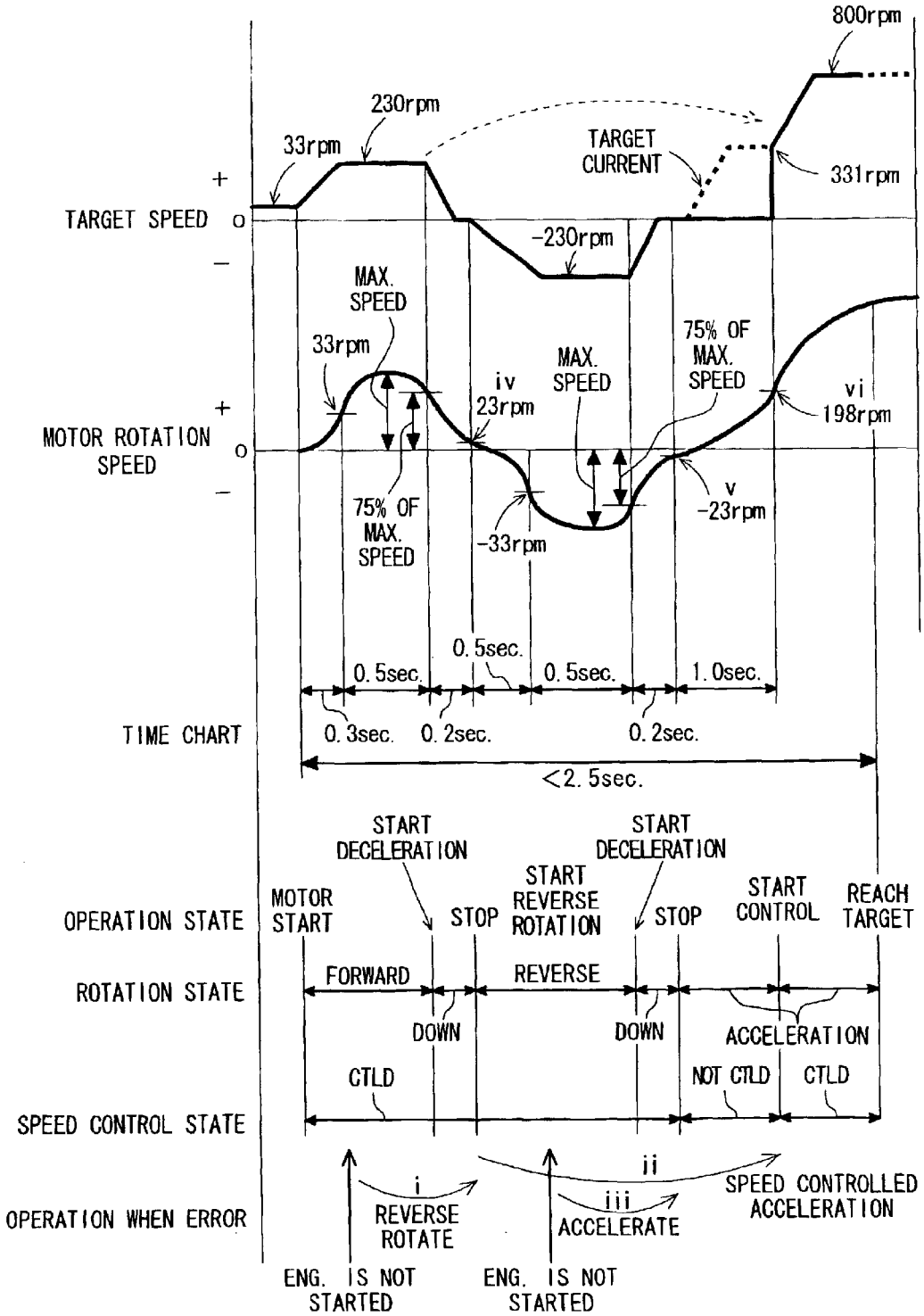
FIG. 9 is a time chart of essential portions of the start control.

FIGS. 7 and 8 are flowcharts of start control of the engine generator 1, and FIG. 9 is a time chart of the start control. In step S1 in FIG. 7, it is judged whether an engine start command is input. If the engine start command is input, the procedure is proceeded to step S2, and the starter motor 3*a* is rotated so as to drive the engine 2 in the forward rotation direction. In step S3, it is judged whether time T1 as a first period of time (e.g., 0.3 seconds) is elapsed after the start of forward rotation of the engine of step S2. The time T1 is time during which it is judged whether it is necessary to keep energizing the starter motor 3*a* in the forward rotation direction. In step S4, it is judged whether the starter motor 3*a* starts rotating by judging whether the rotation speed of the starter motor 3*a* is equal to or higher than a start-completion speed (e.g., 33 rpm) which is a first speed. If the rotation speed does not become equal to or higher than the start-completion speed until the time T1 is elapsed, the energizing operation of the starter motor 3*a* in the forward rotation direction is stopped, the procedure is proceeded to step S11, and the reverse rotation of the starter motor 3*a* is started as indicated by an arrow i in FIG. 9.

If the rotation speed of the starter motor 3*a* becomes equal to or higher than the start-completion speed, a result in step S4 becomes affirmative, the procedure is proceeded to step S5. In step S5, the starter motor 3*a* is rotated forward and is controlled such that the speed is converged to a forward rotation target speed (e.g., 230 rpm) for positioning. In step S6, it is judged whether time T2 as a second time of period (e.g., 0.5 seconds) is elapsed after the start of forward rotation in step S5. The time T2 is time during which it is judged whether the positioning and the reverse rotation is needed or not. The procedure is proceeded to step S7 until the time T2 is elapsed.

In step S7, it is judged whether the rotation speed of the starter motor 3*a* is reduced to a reverse rotation judging speed (e.g., 75% of maximum speed heretofore) which is a second speed. With this judgment, it is judged whether the speed is adversely reduced when the crank angle is near the high load position before the top dead center. If the rotation speed is not reduced (negative in step S7) until the time T2 is elapsed, that is, affirmative in step S6, it is judged that the engine is in a light load region after the top dead center and the acceleration is possible in this state. Therefore, in this case, the rotation mode of the starter motor 3*a* is not shifted to the reverse rotation, and the procedure is proceeded to step S23 shown in FIG. 8 for accelerated forward rotation with speed controlled as indicated by an arrow ii in FIG. 9.

If the rotation speed is reduced to a turn-over judging speed, a result in step S7 is affirmative, the procedure is proceeded to step S8, and the forward rotation of the starter motor 3*a* is stopped by controlling the brake. If time T3 (e.g., 0.2 seconds) which is for judging the stop is elapsed, that is, affirmative in step S9 or if the rotation speed becomes equal to or less than a third speed (e.g., 23 rpm as indicated by a symbol iv in FIG. 9) at which it is judged that the rotation is stopped, that is, affirmative in step S10, it is judged that the starter motor 3*a* is not normally rotated further, and the procedure is proceeded to step S11.

In step S11, the starter motor 3*a* is reversely rotated to rotate the engine 2 reversely. In step S12, it is judged whether time T4 (e.g., 0.3 seconds) is elapsed after the start of reverse rotation of the motor of step S11. The time T4 is judging time during which the forward rotation is shifted to reverse rotation where the rotation speed is controlled. If the speed reaches start-completion speed (e.g., 33 rpm) before the time T4 is elapsed, a result of step S13 becomes affirmative, and the procedure is proceeded to step S14. If the speed does not become equal to or higher than the start-completion speed even if the time T4 is elapsed, the step is proceeded to S20 for accelerated forward rotation as indicated by an arrow iii in FIG. 9.

In step S14, the starter motor 3*a* is reversely rotated where the rotating speed is controlled. In step S15, it is judged whether time T5 (e.g., 0.5 seconds) is elapsed after the start of the reverse rotation of step S14. The time T5 is time during which it is judged whether the reverse rotation of the starter motor 3*a* should be stopped. The procedure is proceeded to step S16 until the time T5 is elapsed. In step S16, it is judged whether the rotation speed of the starter motor 3*a* is reduced to a turn-over judging speed as a third speed (e.g., 75% of maximum speed heretofore). With this judgment, it is judged whether the engine load is increased and the crank angle reaches the high load position before the top dead center (corresponding to a position after the top dead center in the forward rotation direction).

If the time T5 is elapsed (affirmative in step S15), or if the rotation speed of the starter motor 3*a* is reduced (affirmative in step S16), the procedure is proceeded to step S17, and the reverse rotation of the starter motor 3*a* is stopped by brake controlling. If time T6 (e.g., 0.2 seconds) for judging the stop is elapsed that is affirmative in step S18, or the rotation speed is reduced to a speed at which it is judged that the rotation is stopped, that is, affirmative in step S19 (e.g., the rotation speed becomes equal to or lower than 23 rpm as indicated by a symbol v in FIG. 9), the procedure is proceeded to step S20 shown in FIG. 8 for accelerating the forward rotation of the starter motor 3*a*.

In step S20 in FIG. 8, the forward rotation is accelerated. The speed is not controlled during the forward rotation after the positioning, while a current value is fixed and the forward rotation is accelerated. If the rotation speed of the starter motor 3*a* becomes equal to the control starting speed (e.g., 198 rpm as indicated by a symbol vi in FIG. 9), the rotation mode is shifted to the speed-controlled forward rotation. An initial control target value is set to 331 rpm for example. This control target value is increased with a predetermined ratio (e.g., 3,300 rpm/sec).

In step S21, it is judged whether acceleration limiting time T7 with constant current is elapsed. In step S22, it is judged whether the speed becomes equal to or higher than the control starting speed. If the time T6 is elapsed or the rotation speed of the starter motor 3*a* becomes equal to or higher than the control starting speed, the procedure is proceeded to step S23, and the speed is controlled in accordance with the control target value. Since the control target value is gradually increased, the actual rotation speed is also gradually increased. In step S24, it is judged whether the rotation speed reaches cranking speed (e.g., 800 rpm). If the rotation speed is increased and a result of step S24 becomes affirmative, the control target value for maintaining the rotation speed at the cranking speed is set to a cranking speed, and the starting sequence is completed. If the speed does not reach the target speed even if predetermined time T8 is elapsed after the speed control in step S23 is started, it is preferable to judge that failure is caused, and the starting operation is stopped. That is, if a result in step S23*a* is affirmative, the starting operation is stopped, and the procedure of this flowchart is completed.

Figure 1:
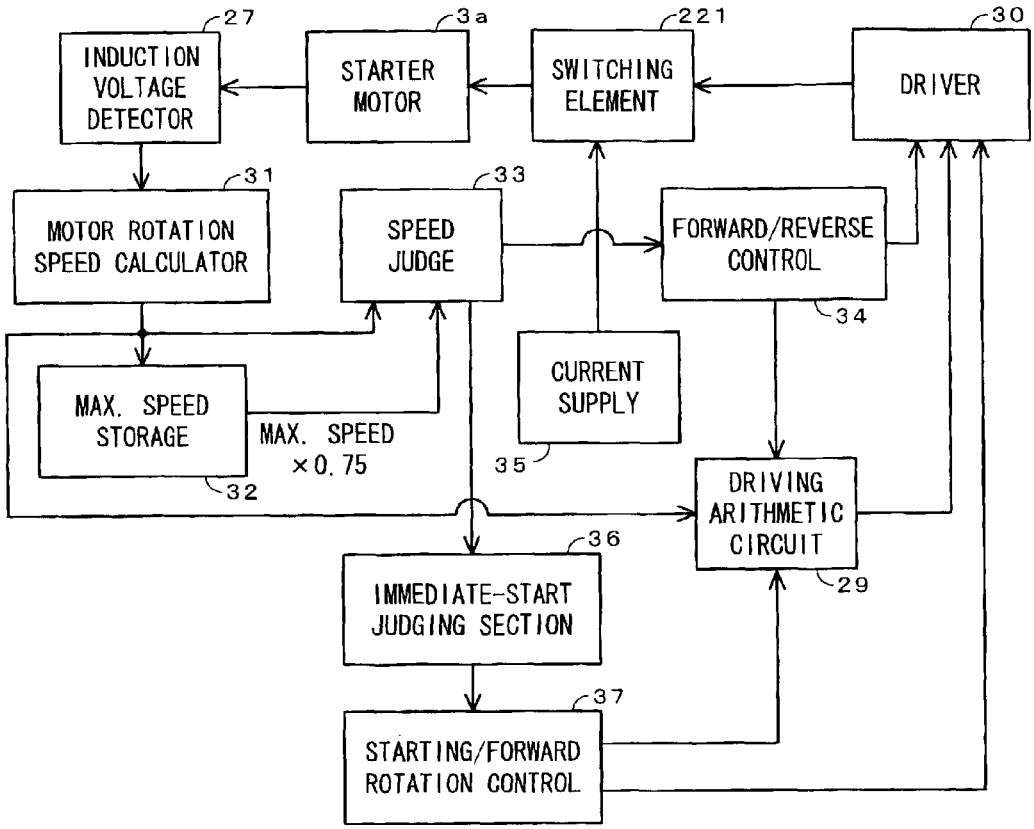
FIG. 1 is a block diagram showing functions of essential portions of the engine starting device according to an embodiment of the present invention.

FIG. 1 is a block diagram showing functions of essential portions of the engine starting and positioning operations. A waveform of induction voltage detected by the induction voltage detector 27 is input to a motor rotation speed calculation section 31. The motor rotation speed calculation section 31 calculates a rotation speed of the starter motor 3*a* based on the cycle of the induction voltage. A maximum speed storing section 32 latches a maximum speed of the starter motor 3*a* which is detected heretofore by the starting control. The maximum speed is cleared if the direction of rotation is changed. A speed judging section 33 compares a current rotation speed of the starter motor 3*a* and a predetermined turn-over judging speed (e.g., 75% of the maximum speed) with each other, and if the current rotation speed is equal to or lower than the turn-over judging speed, the speed judging section 33 outputs a speed reduction detecting signal to a forward/reverse rotation control section 34.

The forward/reverse rotation control section 34 stops the starter motor 3*a* and supplies a turn-over command to a driving section 30 in response to the speed reduction detecting signal. The forward/reverse rotation control section 34 inputs a control target value at the time of the forward rotation and the reverse rotation to the driving arithmetic circuit 29 together with the turn-over command. The driving arithmetic circuit 29 calculates a cycle for driving a switching element 221 so as to control the rotation speed of the starter motor to this control target value. The starter motor 3*a* is controlled such that the starter motor 3*a* rotates at a speed determined by a driving cycle of the switching element 221.

An immediate starting-judging section 36 monitors, for a predetermined time, whether there exists the speed reduction detecting signal from the speed judging section 33 in the forward rotation at the time of the starting operation. If the immediate starting-judging section 36 does not detect the speed reduction detecting signal even after the predetermined time is elapsed, i.e., if it is judged that the starter motor 3*a* is rotated at a predetermined speed (second speed), the immediate starting-judging section 36 inputs an accelerated forward rotation command signal to a starting/forward rotation control section 37. The starting/forward rotation control section 37 inputs a forward rotation command to the driving section 30 in response this signal, and inputs a control target value for accelerating the forward rotation to the driving arithmetic circuit 29. With this operation, it is possible to maintain the forward rotation for positioning when the load is light, and to immediately start the starting operation. A current supply section 35 supplies the initial excitation current and starting current to the starter motor 3*a* at the time of positioning and at the time of acceleration of forward rotation thereafter.

According to this embodiment, the engine is first rotated forward to a position where the engine load is increased and then, the engine is reversely rotated and is again stopped at a position where the engine load is increased. From this position, the forward rotation speed is accelerated at a dash up to a value at which cranking can be carried out. By stopping the rotation at the position where the engine load is increased in this manner, the load is reduced at the sequential turn-over to forward rotation and thus, it is easy to accelerate the forward rotation. Therefore, by supplying the starting current after the positioning by the forward rotation and reverse rotation, the inertia force can be used, and it is possible to easily get over the compression stroke and to carry out the cranking operation.

In the above embodiment, the rotation speed of the motor is calculated based on the cycle of the induction voltage of the starter motor. When the starter motor is controlled by a method shown below, it is possible to calculate the rotation speed by current supplied to stationary winding of the starter motor.

Figure 10:
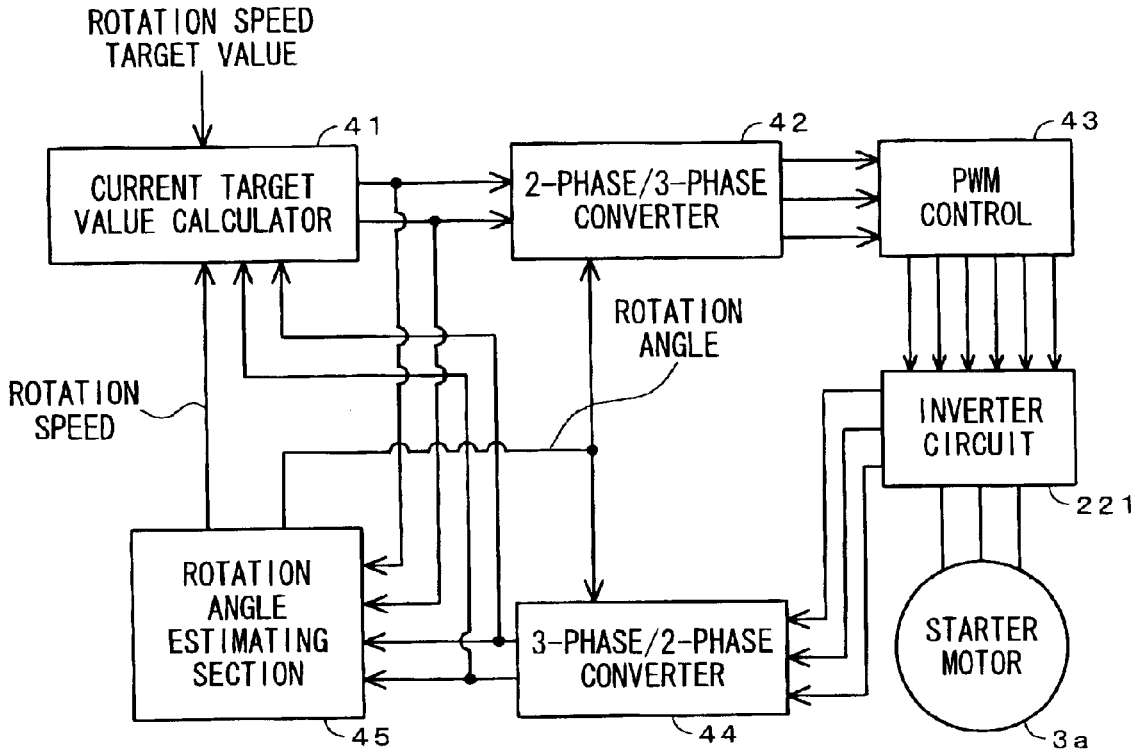
FIG. 10 is a block diagram showing a structure of a starter motor control device of a modification.

FIG. 10 is a block diagram showing a structure of a starter motor control device according to a modification. In the following explanation, that axis of magnetic flux formed by magnets 11 provided along an outer periphery of the rotor 12 of the starter motor 3*a* which passes through the rotor 12 in a direction of the diameter is called d-axis. That axis of magnetic flux formed by stator coil which passes through the rotor 12 in the direction of the diameter is called q-axis. By vector-decomposing current of layers in the directions of the d-axis and q-axis, the operation of the starter motor 3*a* is grasped, and control is carried out based on the vector-decomposed current.

In FIG. 10, the starter motor control device comprises a current target value calculation section 41, a two-phase/three-phase converting section 42, a PWM control section 43, an inverter circuit 221 comprising a switching element, a three-phase/two-phase converting section 44, and a rotation angle estimating section 45. The current target value calculation section 41 calculates a q-axis current output value based on a q-axis current target value determined based on the reverse rotation target value and a current (q-axis current measurement value) which is actually supplied to the starter motor 3*a*. The current target value calculation section 41 also calculates a d-axis current output value based on the d-axis current measurement value and a rotation speed estimated by the rotation angle estimating section 45. The q-axis current output value and the d-axis current output value are input to the two-phase/three-phase converting section 42 and the rotation angle estimating section 45.

The two-phase/three-phase converting section 42 converts the input into three-phase PWM data and outputs the same to the PWM control section 43. The PWM control section 43 calculates ON/OFF duty of the switching elements of the inverter circuit 221 based on the PWM data, and inputs an ON/OFF signal to the inverter circuit 221. The inverter circuit 221 detects current of each phase, and inputs the same to the three-phase/two-phase converting section 44. The q-axis current measurement value and the d-axis current measurement value output from the three-phase/two-phase converting section 44 are input to the rotation angle estimating section 45 and the current target value calculation section 41.

The rotation angle estimating section 45 estimates the rotation angle (rad) and rotation speed (rad/sec) based on deviation between the last q-axis current output value and the d-axis current output value, and between the current q-axis current measurement value and the d-axis current measurement value. The rotation angle is supplied to the two-phase/three-phase converting section 42 and the three-phase/two-phase converting section 44, and the rotation speed is supplied to the current target value calculation section 41. The rotation angle estimating section 45 may have a structure disclosed in Japanese Patent Application Laid-Open No. H8-308286 for example.

In the control of start of this embodiment, the rotation speed information of the starter motor 3*a* used for the forward rotation and reverse rotation for positioning the crankshaft 4 and the accelerated forward rotation for starting can be determined based on the rotation speed estimated by the rotation angle estimating section 45.

Figure 11:
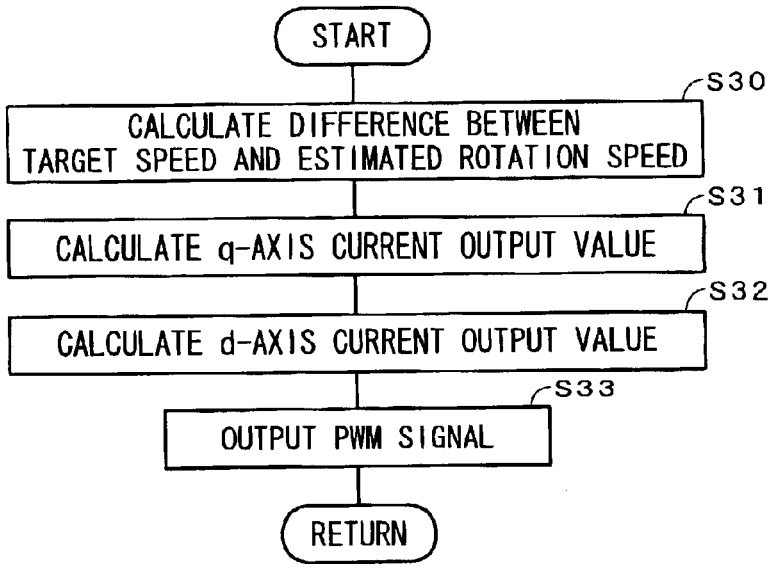
FIG. 11 is a flowchart of rotation speed control.

FIG. 11 is a flowchart of rotation speed control by the q-axis current. In FIG. 11, a difference between a target value of a motor rotation speed and an estimated rotation speed is calculated in step S30. In step S31, the q-axis current output value is calculated based on the speed difference calculated in step S30. A calculation equation which is set such that the q-axis current output value is increased as the speed difference is greater is used. In step S32, the d-axis current output value is calculated based on the q-axis current measurement value and the current rotation speed. A calculation equation which is set such that the d-axis current output value is increased as the q-axis current measurement value and the current rotation speed are greater is used. In step S33, a PWM signal which is used for controls the inverter circuit 221 determined by the q-axis current output value and d-axis current output value is output. In this control, a phase deviation of the q-axis current is generated by the d-axis current value. By this phase deviation, a demagnetization effect is generated by armature reaction effect, and the field of the starter motor 3*a* is reduced. Therefore, the rotation speed of the starter motor 3*a* is controlled to the target rotation speed.

As apparent from the above explanation, according to inventions of claims 1 to 4, it is detected that the rotation speed of the motor is not reduced, and it is judged that the engine rotation position or piston position is not in the high load region near the compression top dead center. Therefore, when the engine is not in the high load region, the engine is swiftly rotated forward, and it is possible to accelerate the engine to the cranking speed at a dash.

According to the invention of claim 2, if it is judged that the engine is in the high load region, it is possible to shift the engine to a high load region of the opposite side utilizing inertia force by the reverse rotation from the previous high load region, and to move the rotation position of the engine to a position where inertia force for forward rotation can sufficiently be obtained. Therefore, in the next forward rotation from the high load region, it is possible to get over the high load region before the top dead center of the compression stroke at a dash while utilizing great inertia force together with the starting current, and to accelerate the engine to the cranking speed.

According to the invention of claim 1 or 2, it is possible to reliably judge whether the engine is in the high load region if the motor rotation speed is maintained at a level equal to or higher than a predetermined value without using a position detection sensor or if the motor rotation speed is reduced to a predetermined value, and it is unnecessary to confirm or detect the starting position of the motor.

Further, according to the inventions of claims 3 and 4, the rotation speed of the motor, that is, the rotation speed of the engine at the time of the starting operation is detected based on the induction voltage of the winding or current supplied to the winding, and it is possible to determine the turn-over position of the forward rotation and the reverse rotation of the motor based on the rotation speed without providing a rotation position sensor for the motor or the engine.

What is claimed is:

1. An engine starting device for internal combustion engine comprising:

a brushless type motor capable of reverse rotation for starting an engine, wherein said motor has no fixed position sensor for detecting a rotation position;

a rotation speed detecting means for detecting rotation speed of the motor; and a drive-control means for driving the motor in accordance with a starting-target revolution number when the following two conditions, in which an initial excitation current, which is smaller than a current supplied during ordinary operation, is allowed to flow through the motor to forward rotate the engine, are satisfied: a first condition in which the rotation speed reaches a first speed within first period of time from when the motor is started to rotate, and a second condition in which a second speed higher than the first speed is obtained after second period of time longer than the first period of time is elapsed.

2. The engine starting device for internal combustion engine according to claim 1, wherein the drive-control means flows the initial excitation current through the motor so as to rotate the engine reversely when at least one of the two conditions is not satisfied, and after the rotation speed is once increased and then the rotation speed is reduced to a value equal to or lower than a third speed, the drive-control means drives the motor forward in accordance with the starting-target revolution number.

3. The engine starting device for internal combustion engine according to claim 1 or 2, wherein the motor is a brushless motor, the engine starting device has three phase stationary windings, and when driving electricity is allowed to flow through two phases, a rotation position signal and a rotation speed signal of a rotor are formed based on a voltage signal which is induced to a winding which is not excited, and the rotation speed detecting means detects the rotation speed of the motor based on the rotation speed signal.

4. The engine starting device for internal combustion engine according to claim 1 or 2, wherein the motor is a brushless motor, a rotation position signal and a rotation speed signal of a rotor are formed based on a difference between a current output value which passes through a stationary winding and a current measurement value of the stationary winding, and the rotation speed detecting means detects the rotation speed of the motor based on the rotation speed signal.

* * * * *